United States Patent [19]

Ludwig

[11] Patent Number: 5,009,215

[45] Date of Patent: Apr. 23, 1991

[54] ARROW REST AND HOLDER APPARATUS

[76] Inventor: James E. Ludwig, 4063 Ensign Ave. North, Minneapolis, Minn. 55427

[21] Appl. No.: 552,796

[22] Filed: Jul. 2, 1990

[51] Int. Cl.[5] ..... F41B 5/00

[52] U.S. Cl. ..... 124/44.5; 124/24.1

[58] Field of Search ..... 124/23.1, 24.1, 25.6, 124/44.5, 88

[56] References Cited

U.S. PATENT DOCUMENTS

| | | | |
|---|---|---|---|
| 2,743,716 | 5/1956 | Wendt | 124/44.5 |
| 2,777,435 | 1/1957 | Brooks | 124/44.5 X |
| 3,372,686 | 3/1968 | Losh | 124/24.1 |
| 3,504,659 | 4/1970 | Babington | 124/44.5 X |
| 4,038,960 | 8/1977 | Ludwig | 124/44.5 |
| 4,236,497 | 12/1980 | Troncoso, Jr. | 124/44.5 X |
| 4,579,101 | 4/1986 | Bateman, III | 124/44.5 |
| 4,662,346 | 5/1987 | Laffin | 124/44.5 |
| 4,865,007 | 9/1989 | Saunders | 124/24.1 |

*Primary Examiner*—Randolph A. Reese
*Assistant Examiner*—Jeffrey L. Thompson
*Attorney, Agent, or Firm*—Clayton R. Johnson

[57] ABSTRACT

An archery bow rest shelf portion amounts brackets having upper and lower horizontal arms that respectively mount an arrow holder and an arm rest device for pivotal movement between generally vertical extending positions for engaging opposite sides of the arrow shaft to aid in retaining the arrow in an emplacement position and stabilizing an arrow as it is being propelled by the bow string. The swing arm is generally of a frusto-sector shape with its forward base corner portion pivotally mounted on the lower leg between the vertical position extending above the first leg to a datum position having its arrow supporting, arcuately curved surface forwardly of its vertical position and extending to a lower elevation. The holder arm in pivotally depending from the second arm is movable to have its terminal edge that is remote from the second leg pivot more remotely forwardly of its terminal edge in the holder generally vertical position to be of a minimum vertical spacing above the supporting surface in the swing arm vertical position by a dimension greater than the diameter of the arrow shaft.

15 Claims, 2 Drawing Sheets

ARROW REST AND HOLDER APPARATUS

BACKGROUND OF THE INVENTION

Arrow rest and holder mechanism mounted on an archery bow sight window section to aid in holding and aiming an arrow.

In my U.S. Pat. No. 4,038,960 there is disclosed an arrow holder that includes an arm pivotally mounted on the bow and having an arcuate notch that together with the bow provides correct placement of an arrow but releases the arrow in response to forward movement of the arrow.

Losh, U.S. Pat. No. 3,372,686, discloses a generally triangular shaped arm rest member that is pivotally mounted and is resiliently retained in a datum position to have one apex abut against the arrow rest shelf and a second apex bearing against the bottom surface of an arrow shaft. During the shooting operation, the rest pivots to move out of the path of the movement of the feathers.

Peck, U.S. Pat. No. 4,324,221, discloses a pair of conical members rotatably mounted on a rod with their minor bases being resiliently retained in abutting relationship to support the arrow shaft. It is indicated that the device absorbs the downward and lateral forces as the arrow is propelled forwardly.

U.S Pat. Nos. 3,135,255; 3,935,854; 4,236,497 to Hoyt, Troncosco Jr. and Troncosco Jr. respectively disclose arrow rest devices for supporting an arrow shaft above the arrow rest shelf.

In order to provide an improved arrow rest for use in combination with a bow having an arrow rest shelf, this invention has been made.

SUMMARY OF THE INVENTION

The arrow rest apparatus includes a somewhat frusto-sector shaped swing arm having its minor base edge portion pivotally mounted on a bracket that in turn is mounted by an archery bow adjacent the bow arrow rest shelf. Opposite the minor base portion the swing arm has an arcuate edge portion that for the most part is arcuately curved about the pivot axis and defines a V-shaped trough in which the arrow shaft rests. The arcuate surface extends to a first elevation when the arrow is in the bow string taut (arrow shooting) position and moves forward and downwardly to its arrow "datum position" when the bow string is released to propel the arrow. For purposes of this description, "datum position" refers to the position of the swing arm wherein the arrow nock properly engages the bow string and the arrow shaft rests on the swing arm arcuate surface prior to drawing the bow string rearwardly to increase the tension in the bow string above that with the bow string in its non-drawn position and the swing arm thereby being pivoted upwardly and rearwardly to its shooting position.

Advantageously the arrow rest apparatus is used in combination with a pivotally mounted holder arm that aids in preventing the arrow shaft moving transversely off the swing arm surface when the swing arm is in its shooting position and the arrow shaft extends between the holder in its datum position and the swing arm.

One of the objects of this invention is to provide new and novel means to aid in providing correct arrow emplacement while a bow and strung arrow are being carried about in a non-shooting position and an arrow is being drawn to its shooting position. Another object of this invention is to provide new and novel means for releasing an arrow for free flight in response to forward movement of an arrow shaft. A further object of this invention is to provide new and novel means that moves and serves as an arrow rest as the arrow is drawn from its non-shooting position toward its drawn shooting position.

For purposes of describing the invention, for the most part it will be described as if the bow is in a position that the bow string in its non-partially drawn position is vertical.

Figure 2:
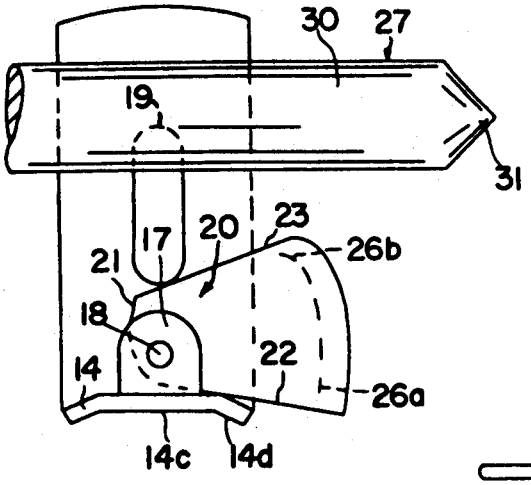
FIG. 2 is a side view of the structure shown in FIG. 1 with the structure shown in the FIG. 1 position other than the bow portion is not shown.
Figure 1:
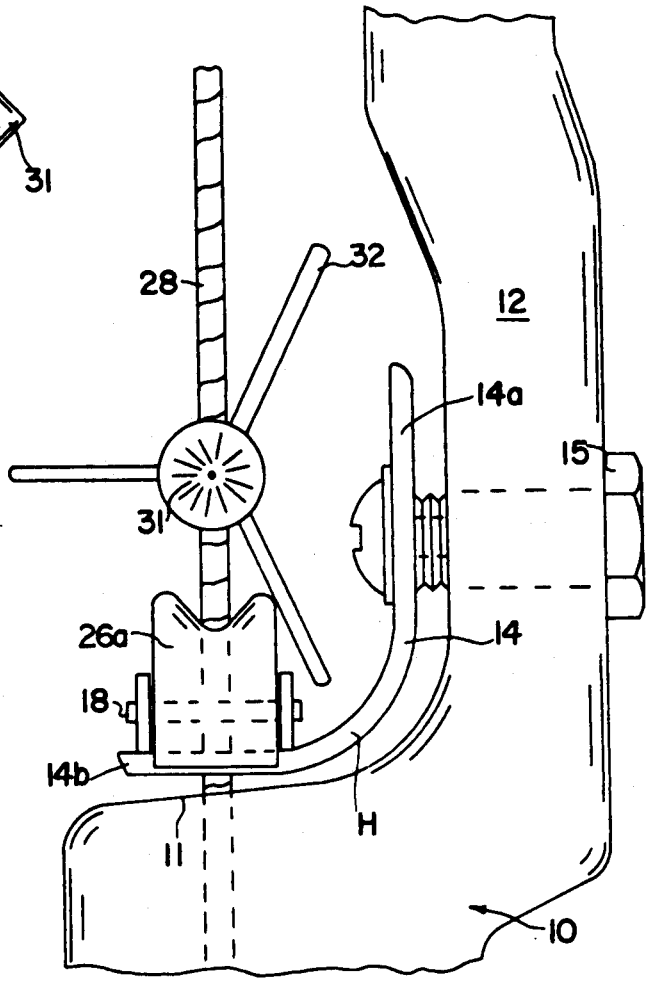
FIG. 1 a front view the portion of the bow having the arrow rest shelf, and the swing arm in its datum position just after the bow string is released and the arrow is being propelled forwardly, said view showing the first embodiment of the invention.

Referring in particular to FIGS. 1 and 2 the sight window portion of the handle of the archery bow, generally designated 10, has a generally horizontal arrow rest shelf 11 with an adjacent upwardly extending portion 12 to which the vertical leg 14*a* of a generally L-shaped bracket 14 of the arm rest apparatus of this invention H is secured by a nut and bolt 15. The transversely extending horizontal leg 14*b* of the bracket extends outwardly from the upright portion 12 just above the shelf. The bolt is extended through a vertically elongated slot 19 in the vertical leg of the bracket, the slot permitting limited vertical adjustment of the bracket relative to the arm rest shelf 11 when the nut is partially unthreaded.

The somewhat frusto-sector shaped swing arm, generally designated 20, has its minor base, leading corner portion mounted by a transverse pivot 18 that in turn is mounted by transversely spaced ears 17 that are secured to the web portion 14*c* of the horizontal leg 14*b* to extend thereabove. The swing arm base portion has a generally linear base edge 21 that extends between the radially outwardly extending leading and trailing edges 22, 23 respectively. For purposes of facilitating the description, the leading edge will be referred to as that edge of the swing arm that extends generally vertically and opposite the bow string when the swing arm has been pivoted in the direction of arrow 25 about pivot 18 to its shooting limited position by the base edge portion longitudinal opposite the pivot abuts against the horizontal bracket leg. The edges 22, 23 diverge from one another in a direction away from the base edge, the leading edge extending at about right angles to the base edge. The pivot aperture 20*a* is located much more closely adjacent to the leading edge 22 than to edge 23.

Additionally, the swing arm has a generally V-shaped, arcuately curved edge (groove) 26 that is opposite (radially outwardly) of the base edge and extends between the leading and trailing edges 22, 23 to provide an arrow shaft supporting surface The arcuate edge throughout the major portion of its arcuate length, leading part 26*a*, of the edge 26 has a radius of curvature emanating from the central axis of the pivot 18 while the trailing part 26*b* in a direction away from the edge 22 extends more closely adjacent toward the central axis. The edge portion 26*a* intersects with the leading edge 22 while edge portion 26*b* intersects with the trailing edge 23. Advantageously the arcuate length of the leading part is more than twice as great as the corresponding dimension of edge part 26*b*.

Figure 3:
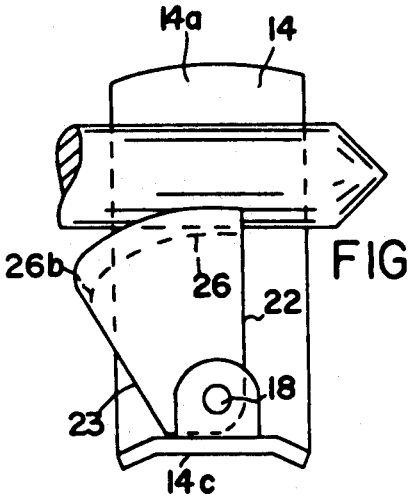
FIG. 3 shows the swing arm and arrow of the first embodiment in their fully drawn arrow shooting position.
Figure 4:
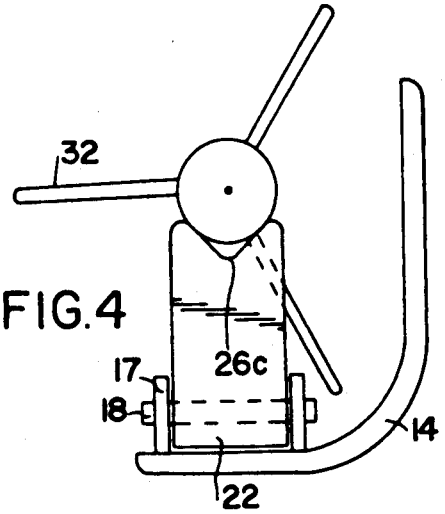
FIG. 4 is a front view showing the structure of FIG. 3 in the FIG. 3 position.

The pivotal movement of the swing arm in a rearward direction (arrow 25) is limited to its upright shooting position of FIG. 3 by the base edge abutting against bracket transverse web 14*c*. In the shooting position the center of mass of the swing arm is above and rearwardly of the pivot axis and thus, at this time, the swing arm tends to remain in its shooting position. The pivot movement of the swing arm in the direction opposite of arrow 25 is limited by the leading edge 22 abutting against the horizontal leg 14*b* of the bracket, this being considered as the datum position of the swing arm. At this time the center of mass of the swing arm is above and forwarded of the swing arm pivot axis. The maximum elevation of the apex portion of the arcuate edge portion 26*a* when the swing arm is in its shooting position is higher than the maximum elevation of any part of the swing arm in its datum position. Additionally the apex 26*c* of the edge 26 is transversely spaced from the bracket vertical leg and in alignment with the vertical plane of the bow string 28 that extends perpendicular to the axis of the pivot pin 18.

In the event it is desired that the swing arm extend to a lower maximum elevation than that shown in FIG. 2 without decreasing the arcuate length of the arcuate edge 26, the leading edge portion of the swing arm may be provided with a cutout (not shown) radially intermediate the aperture 20 and the edge 26 that, when the swing arm is in its datum position, opens downwardly and to the juncture of the transverse forwardly and downwardly inclined horizontal bracket leg transversely extending portion 14*d* and the web portion 14*c*. Of course the minimum elevation is limited by the angle that the edge 23 extends relative to the base edge.

Figure 5:
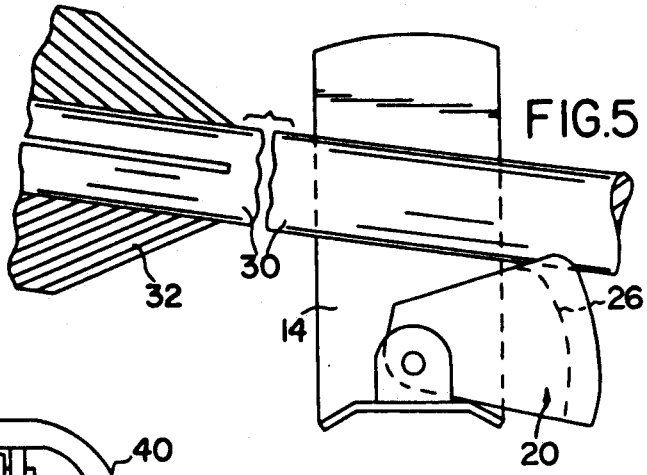
FIG. 5 is a fragmentary side view of the arrow resting on the swing arm in its datum position, said view being of structure of the first embodiment.
Figure 8:
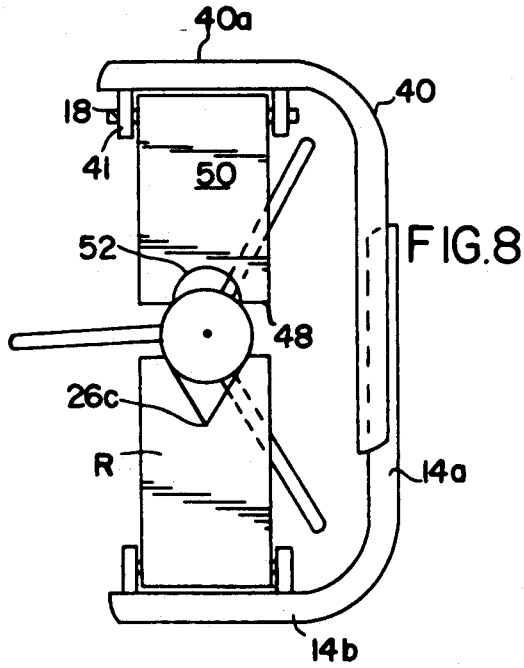
FIG. 8 is a front view of the structure of FIG. 7 in the FIG. 7 position.

When the arrow is manually held in a nocked position with the bow string in its non-drawn position and the swing arm in its datum position, usually the vanes 32 of the arrow 27, are angularly located so as to have a path of movement to avoid striking the arrow rest in its datum position when the arrow is propelled, and the arrow shaft 30 abuts against groove trailing edge portion 26*b*. At this time the arrow shaft extends downwardly in a forward direction (see FIG. 5). Now, upon retracting the bow string and arrow 27, the swing arm is pivoted upwardly and rearwardly in the direction of arrow 25 to its shooting position as a result of frictional engagement of the arrow shaft with the swing arm. This results in the portion of the arrow in engagement with the swing arm moving to a higher elevation to its desired shooting position whereby the shaft is moved toward and to extend generally horizontally (see fully drawn shooting position in FIG. 3 wherein the arrow point 31 is forwardly and closely adjacent to the bow). Due to the provision of the groove 26, transverse movement of the arrow is limited, i.e. aids in retaining the arrow in its desired transverse position relative to the bow as the arrow is retracted and propelled forwardly.

Upon releasing the bow string and arrow after having been moved to their fully drawn position, the arrow shaft moves forwardly, and due to the frictional engagement with the walls defining groove 26, the swing arm is pivoted in the direction opposite arrow 25. At the time that the propelled arrow has its shaft engaging the groove walls adjacent to the juncture of the arcuate edge portions 26*a*, 26*b*, the center of mass of the swing arm is located forwardly of the pivot axis, and thus either due to inertia and/or the location of the center of mass the swing arm continues to pivot even though the arrow shaft moves out of engagement of the groove walls. Thus prior to the vanes 32 moving forwardly to extend transversely in alignment with the swing arm, the swing arm has moved back to its datum position (see FIG. 2) out of engagement with the arrow shaft.

The arcuate length of the apex of the V-shaped groove (trough) is greater than the dimension of the base edge in a direction perpendicular to the transverse pivot axis of the pivot pin 18 while the minimum spacing of the apex from the pivot is also greater than the above dimension of the base edge.

Even though the use of the first embodiment has been described with the movement of the bow string and arrow resulting in the swing arm moving to the swing arm shooting position, it is to be understood the swing arm may be manually moved to the swing arm shooting position prior to moving the arrow into engagement with the swing arm and the arrow engaging the bow string.

Referring to FIGS. 7–10, the second embodiment of the invention includes the arrow rest apparatus of the first embodiment together with an arrow holder H. The arrow holder includes a generally L-shaped bracket 40 that advantageously is of the same size and shape as the bracket 14 and is secured to the bow by the nut and bolt 15 with the bolt extending through the bracket slot 42 with its horizontal leg 40*a* above the horizontal leg 14*b*, i.e. the bracket 40 being upside down relative to the bracket 14. The transverse web 40*c* of the horizontal leg of the bracket 40 depending mounts the transversely spaced ears 41 which in turn the pivot pin 18.

The pin pivotally mounts a holding arm, generally designated 44, that is formed of resilient material, for example the same as that disclosed in my patent. In side view the holder arm 44 is generally of a trapezoidial shape and has its corner portion formed by the junction of its major base edge 47 and leading edge 50 pivotally mounted by the pivot pin. The minor base edge 48 and the major base edge 47 advantageously may extend at about right angeles to the leading edge 50 while the trailing edge 45 extends at acute angles relative to the base edges. The center of mass of the holder arm is located relative the pivot pin such that the arm pivots in the direction opposite of arrow 51 to the arm datum position that the major base 47 abuts against the bracket horizontal arm to limit the pivotal movement of the arm in its relaxed condition to such a position. In the datum position the leading edge 50 extends generally vertically.

Figure 7:
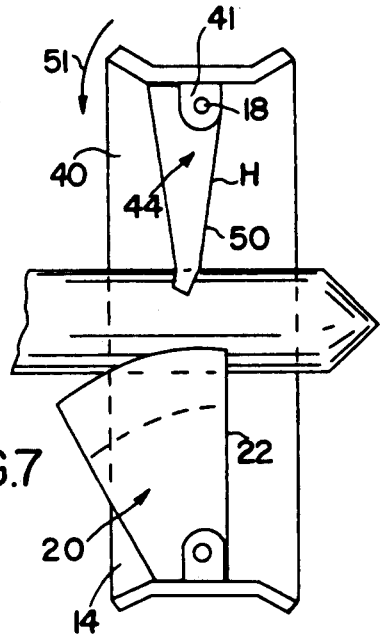
FIG. 7 is a side view of the second embodiment showing swing arm and arrow holder in the arrow fully drawn position.
Figure 9:
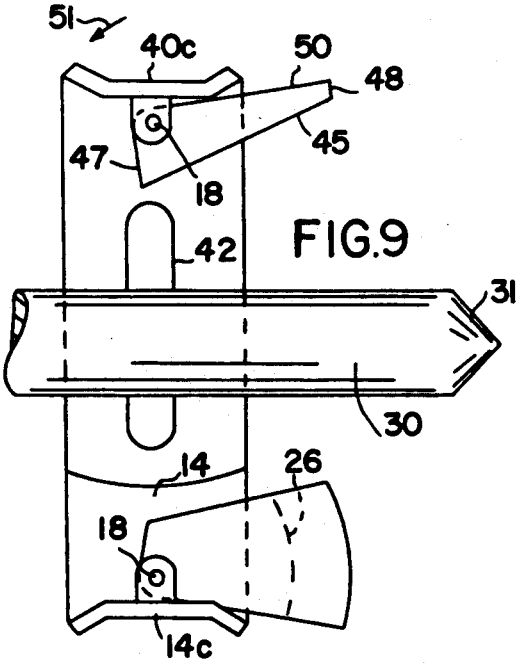
FIG. 9 is a side view that is the same as FIG. 7 other than it is just after the bow string has been released and the swing arm has moved to its datum position.
Figure 10:
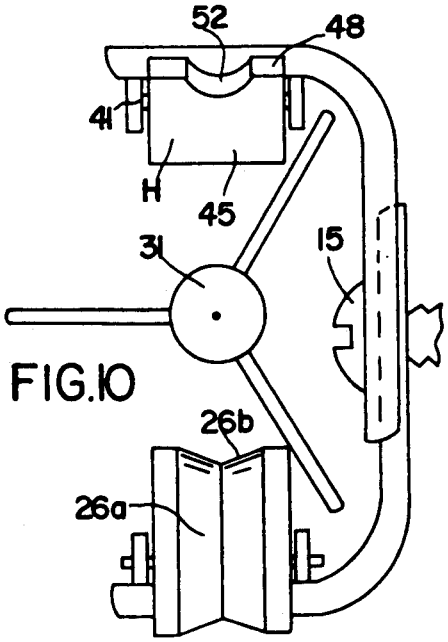
FIG. 10 is a front view of the structure of FIG. 9 in the FIG. 9 position.

The minor base edge has a transversely centered, arcuately curved cutout 52 that opens downwardly when the arm is in its datum position. As may be noted from FIG. 8, when the holder arm is in its datum position and the swing arm is in its shooting position, the non-cut out portion of the edge 48 is vertically spaced from the vertically most adjacent part of the swing arm by less than the diameter of the arrow shaft. That is, at this time at least the lower part of the arm flexes as shown in FIG. 7. Further the greatest depth of the cut-out is substantially transversely aligned with the apex of the groove of the swing arm. When the arm in its relaxed condition in its limited position in the direction of the arrow 51 with the leading edge abutting against the bracket horizontal arm and the swing arm in its datum position, the minimum vertical spacing between them is many times greater than the diameter of the arrow shaft (see FIGS. 9 and 10).

When the holder arm and the swing arm are in their datum positions, the minimum vertical spacing between them is substantially greater than the diameter of the arrow shaft. In use, if the arrow shaft is positioned on the swing arm in the swing arm datum position, then when the arrow is drawn rearwardly, the swing arm accordingly pivots to its shooting position and the arrow shaft moves into contact with the lower edge portion of the holder arm and will result in flexing of the holder arm such as shown in FIG. 7. Now, upon release of the arrow, the arrow being in frictional engagement with the swing and holder arms results in the adjacent parts of the arms moving forward in the direction of propulsion of the arrow shaft and thence moving vertically apart out of contact with the shaft prior to the vanes contacting the holder arm. In the event the swing arm is manually moved to its shooting position, prior to the arrow shaft being positioned thereon, the lower portion of the holder arm is pivoted forwardly of its datum position. Now, upon drawing the arrow to its arrow shooting position, the frictional engagement of the arrow shaft with the holder arm results in the holder arm moving to a position such as shown in FIG. 7.

Figure 6:
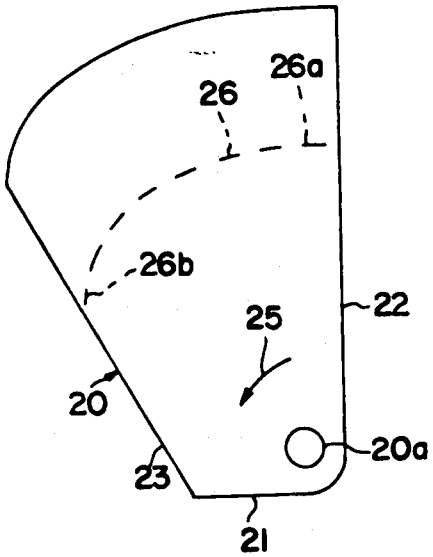
FIG. 6 is an enlarged side view of the swing arm.

As an example of the arm rest apparatus of one embodiment of this invention, the vertical dimension of the edge 22 as shown in FIG. 6 is about ¾", the base edge 21 about ¼", and the trailing edge 23 of a maximum of about ⅝", while the transverse dimension is about ½". The pivot axis is about 1/12" from each of the edges 21, 22, the intersection of edges 21, 22 advantageously being rounded. The leading and trailing edges diverge at an angle of about 60° while the groove side walls diverge at an angle of about 75° and are of a maximum transverse spacing of about 0.312".

It is to be mentioned that even though the apparatus of this invention has been described with reference to the bow having an arrow rest shelf, it can be used with a bow that does not have such a shelf.

What is claimed is:

1. Arrow rest apparatus mountable on an archery bow having a bow handle and a bow string extending rearwardly of the bow handle for supporting an arrow having a shaft, vanes on the shaft and an arrow point when the arrow is in a strung non-drawn position and the arrow is moved to a fully drawn shooting position, comprising a mounting bracket having a transversely extending, generally horizontal leg, a transverse pivot mounted on the horizontal leg above the leg and having a transverse pivot axis, and a generally frusto-sector shaped swing arm having a base edge, leading and trailing edges intersecting with the base edge in longitudinal spaced relationship to one another to diverge in a generally radially outward direction away from the pivot, the intersection of the base and leading edges defining a swing arm corner portion mounted by the pivot for limited pivotal movement between a datum position and an arrow shooting position, and a generally arcuately extending edge extending between and intersecting with the leading and trailing edges radially outwardly of the base edge to provide an arrow shaft supporting surface, the supporting surface having a leading surface portion and a trailing surface portion that extends more closely adjacent to the pivot axis than the minimum spacing of the leading surface portion from the pivot axis.

2. The arrow rest apparatus of claim 1, characterized in that the swing arm has its base edge abutting against the bracket to limit the pivotal movement of the swing arm in a direction from the datum position to the shooting position, the leading surface portion in the swing arm shooting position being longitudinally rearwardly of the leading surface portion in the datum position.

3. The arrow rest apparatus of claim 2, characterized in that the swing arm is of dimensions that the minimum elevation of the leading surface portion in the swing arm shooting position is at a higher elevation than the maximum elevation of the swing arm in its datum position.

4. The arrow rest apparatus of claim 3, characterized in that the swing arm leading edge abuts against the horizontal leg to limit the pivotal movement of the swing arm in a direction from the swing arm shooting position to the swing arm datum position.

5. The arrow rest apparatus of claim 2, characterized in that the swing arm has a generally transversely centered, generally V-shaped trough that defines the supporting surface and that the arcuate length of the leading surface portion is substantially greater than the arcuate length of the trailing surface portion.

6. The arrow rest apparatus of claim 5, characterized in that the trough has an apex, the minimum spacing of the apex from the pivot being greater than the maximum dimension of the base edge in a direction perpendicular to the pivot axis.

7. The arrow rest apparatus of claim 5, characterized in that the arcuate length of the arcuate edge is greater than the corresponding dimension of the base edge.

8. The arrow rest apparatus of claim 5, characterized in that the leading surface portion throughout its arcuate length is curved about a radius emanating from the pivot axis.

9. The arrow apparatus of claim 2 in combination with an arrow holder that includes a second bracket having a horizontal second leg above the first bracket leg, a transverse second pivot parallel to the first pivot dependingly mounted by the second bracket second leg and a holder arm dependingly mounted by the second pivot for pivotal movement between a datum, generally vertically extending position and a second position more remotely spaced from the first pivot than in the holder arm datum position.

10. The arrow apparatus of claim 9, characterized in that the minimum spacing of the holder arm in its datum position from the swing arm in its shooting position is less than the diameter of an arrow shaft and when the holder arm is in its second position and the swing arm is in its shooting position, is greater than the diameter of an arrow shaft.

11. The arrow apparatus of claim 10, characterized in that the swing arm has a generally V-shaped trough defining the supporting surface and that the holder arm in its vertical position has an arcuately curved cutout aligned with and opening toward the first pivot.

12. The arrow apparatus of claim 10, characterized in that the holder arm is made of a flexible material and in its datum position is of a greater vertical dimension then either of its longitudinal and transverse dimensions.

13. Arrow rest aPparatus mountable on an archery bow having a bow handle and a bow string extending rearwardly of the bow handle to support an arrow having a shaft, vanes on the shaft and an arrow point when the arrow is in a strung non-drawn position and the arrow is moved to a fully drawn longitudinally extending shooting position, comprising a mounting bracket having a transversely extending, generally horizontal first leg, a transverse pivot mounted on the horizontal leg above the leg and having a transverse pivot axis, and a swing arm pivotally mounted by the pivot and having wall means defining an arcuately elongated V-shaped arrow supporting groove, and leading and trailing edges intersecting with the groove in substantially spaced relationship to one another to converge in a generally radially direction toward the pivot, the groove having a leading arrow supporting surface portion and a trailing arrow supporting surface portion that extends more closely adjacent to the pivot axis than the minimum spacing of the leading surface portion from the pivot axis, the swing arm being mounted by the pivot for limited pivotal movement between a datum position that the groove is located forwardly of the pivot and an arrow shooting position that at least a major part of the groove is located longitudinally rearwardly of the pivot and that at least the leading part of the groove is at a higher elevation than the maximum elevation of the swing arm in the swing arm datum position, the swing arm abutting against the bracket to limit the pivotal movement of the swing arm in pivotal directions between the datum and shooting positions.

14. Arrow apparatus mountable on an archery bow having a bow handle and a bow string extending rearwardly of the bow handle in longitudinally spaced relationship to the handle to support an arrow having a shaft, vanes on the shaft and an arrow point when the arrow is in a strung non-drawn position and the arrow is moved to a fully drawn longitudinally extending shooting position, comprising a swing arm, a transverse first pivot for pivotally mounting the swing arm, a holder arm, a transverse second pivot for pivotally mounting the holder arm, and bracket means for pivotally mounting the first and second pivots, the bracket means including a transversely extending, generally horizontal first leg mounting the first pivot vertically thereabove, and a transversely extending, generally horizontal second leg vertically above the first pivot for pivotally mounting the second pivot in depending relationship thereto and in parallel relationship to the first pivot, each of the arms being pivotally movable to a generally elongated vertical extending position and having a leading edge, a trailing edge and a transverse terminal edge portion abutable against an arrow shaft to aid in retaining the arrow in a shooting position when the bow string is fully drawn, the holder arm being made of a flexible material, the arm's leading edges being abutable against the bracket means for limiting pivotal movement of the arms from their vertical extending positions in a direction that their terminal edge portions are forwardly of and further apart than in the arm's vertical extending positions to a datum position, the minimum vertical spacing of the terminal edge portions when the swing arm is in its vertical position and the holder arm is in its datum position being greater than the diameter of an arrow shaft.

15. The apparatus of claim 14, characterized in that swing arm terminal edge portion in the swing arm vertical position is arcuately curved in a longitudinal direction and defines an arrow supporting surface having a leading surface part that is circularly curved by radii emanating from the first pivot to intersect with the swing arm leading edge and a trailing surface part that in a rearward direction extends more closely adjacent to the first pivot than the leading surface part and intersects with the trailing edge.

* * * * *